US005971045A

United States Patent [19]

Watanabe

[11] Patent Number: 5,971,045

[45] Date of Patent: Oct. 26, 1999

[54] VENEER LATHE

[75] Inventor: Kenzo Watanabe, Aichi, Japan

[73] Assignee: Meinan Machinery Works, Inc., Obu, Japan

[21] Appl. No.: 09/122,868

[22] Filed: Jul. 27, 1998

[30] Foreign Application Priority Data

Jul. 29, 1997 [JP] Japan ..... 9-219127

[51] Int. Cl.[6] ..... B27L 5/04; B27L 5/02

[52] U.S. Cl. ..... 144/213; 144/209.1; 144/211; 144/357; 144/365; 144/362; 384/99; 384/132; 384/403

[58] Field of Search ..... 82/118, 170, 165; 144/209.1, 211, 212, 213, 215.2, 356, 357, 362, 365; 384/93, 99, 100, 132, 403, 900, 901

[56] References Cited

U.S. PATENT DOCUMENTS

| | | | |
|---|---|---|---|
| 3,670,790 | 6/1972 | Porter et al. | 144/213 |
| 4,221,247 | 9/1980 | Katsuji | 144/213 |
| 4,602,663 | 7/1986 | Browning, Jr. et al. | 144/213 |
| 4,765,380 | 8/1988 | Watanabe | 144/365 |
| 4,790,360 | 12/1988 | Clarke et al. | 144/213 |
| 5,058,639 | 10/1991 | Tagagi | 144/213 |
| 5,141,038 | 8/1992 | Nakaya | 144/365 |
| 5,333,658 | 8/1994 | Albion et al. | 144/213 |
| 5,564,253 | 10/1996 | Nakaya | 144/356 |
| 5,715,879 | 2/1998 | Jones | 144/213 |
| 5,791,388 | 8/1998 | Nakaya | 144/365 |

*Primary Examiner*—W. Donald Bray
*Attorney, Agent, or Firm*—Armstrong, Westerman, Hattorri, McLeland & Naughton

[57] ABSTRACT

A veneer lathe comprising a knife (2) for peeling a log (1), which is secured rotatably to a knife stock, and a roller bar (3) disposed to press a circumferential surface of the log (1) at an upstream side, in relative to said knife (2), of a rotational direction of the log (1). The roller bar (3) has a diameter of not more than 30 mm, and is provided on the circumferential surface thereof with a large number of projections (5) whose height is not higher than the circumferential surface of the roller bar (3). The roller bar (3) is sustained in a sliding bearing (9) and adapted to receive a rotational force from a driving source. The roller bar (3) functions not only as a pressure bar but also as a power transmitting media to rotate the log (1), thereby preventing the generation of lathe check of veneer to be produced.

10 Claims, 11 Drawing Sheets

VENEER LATHE

BACKGROUND OF THE INVENTION

This invention relates to a veneer lathe (peeling machine) provided with a roller bar for peeling a monolithic veneer (hereinafter referred simply to as a veneer) from a log.

There is known a veneer lathe provided with a roller bar, which is designed to peel (or cut off) a veneer from a log by making use of a knife as disclosed in U.S. Pat. No. 3,670,790 (Porter et al. issued on Jun. 20, 1972) wherein the roller bar is arranged parallel with the cutting edge of the knife for cutting a log and is held rotatably in a recessed portion of a holder. More specifically, the recessed portion of the holder is circular in cross-section having a diameter substantially corresponding to the outer diameter of the roller bar, and the roller bar is rotatably sustained (i.e. it is driven following the rotation of the log) in the recessed portion.

There is also known another type of veneer lathe provided with a nose bar-roll having a relatively large diameter as disclosed in U.S. Pat. No. 4,602,663 (Browning, Jr. et al. issued on Jul. 29, 1986) wherein the nose bar-roll is arranged parallel with the cutting edge of the knife for cutting a log and is held rotatably in a recessed portion of a holder. More specifically, the recessed portion of the holder is circular in cross-section having a diameter substantially corresponding to the outer diameter of the roller bar, and the nose bar-roll is rotatably sustained (i.e. it is designed to be driven by driving means) in the recessed portion.

In the case of the former veneer lathe (Porter et al), since the roller bar may be relatively small in diameter, the roller bar for pressing a log can be positioned immediately before the log is cut by the knife, so that the roller bar can be sufficiently functioned as a pressure bar, thus making it possible to obtain a veneer which is relatively smooth in surface and relatively free from so-called lathe check. However, since the force for rotating the log cannot be transmitted from the roller bar, a chuck is employed to press the axial portion of the log so as to transmit any required force from the chuck to the log for cutting the log. Therefore, once the axial portion of the log becomes fragile, the log is broken due to the power transmitting force of the chuck, thereby making it impossible to further continue the peeling work of the veneer lathe.

On the other hand, in the case of the latter veneer lathe (Browning Jr. et al), the driving power required for cutting can be supplied from the nose bar-roll, so that even a log which becomes fragile at the axial portion thereof can be allowed to be peeled. However, since the diameter of the nose bar-roll is relatively large in diameter (at least 15 times as large as the thickness of veneer to be cut by the lathe), if the nose bar-roll is positioned immediately before the knife thereby to sufficiently press a log in order to prevent the lathe check, an excessive force is acted on the log as a whole, so that the log is often caused to bend whereby making it impossible to obtain a veneer of uniform thickness. Therefore, the veneer lathe of this type cannot be positioned immediately before the knife so that a log cannot be sufficiently pressed at the position immediately before the knife. As a result, the nose bar-roll cannot be sufficiently functioned as a pressure bar. Because of this, it is difficult with the veneer lathe of this type to prevent the generation of so-called "fore-splitting", i.e. a splitting that is to be generated immediately before the cutting edge of knife at the occasion of peeling a log. Additionally, the surface of veneer to be obtained would be markedly roughened and at the same time, a big lathe check tends to be generated in the veneer.

BRIEF SUMMARY OF THE INVENTION

The object of this invention is to provide a veneer lathe which is free from the aforementioned problems accompanied with the conventional veneer lathe. More specifically, the object of the present invention is to provide a veneer lathe which is provided with a roller bar functioning not only as a pressure bar but also as a power transmitting media for transmitting at least part of driving power required for cutting a log.

The veneer lathe according to the present invention is constructed as explained below. Namely, the veneer lathe according to the present invention comprises; a knife for peeling a log, which is secured rotatably to a knife stock; a roller bar disposed to press a circumferential surface of the log at an upstream side, relative to said knife, of a rotational direction of the log; a large number of projections having a height which does not extend beyond a circumferential surface of said roller bar; a sliding bearing fixed to said knife stock, rotatably sustaining said roller bar and having a semi-circular space in cross-section which opens to face the log when said cross-section is cut orthogonally to an axial line of said roller bar, said sliding bearing being mounted to face, via said roller bar, the log to be peeled; and driving means for rotating said roller bar sustained by said sliding bearing.

The aforementioned projections may be formed all over the circumferential surface of the roller bar. Alternatively, the roller bar may be constructed such that a plurality of annular smooth surfaces, each being contiguous in the rotational direction of the roller bar and having a desired width, are formed at intervals on the circumferential surface of the roller bar and along the direction of axial line of said roller bar, other surface portion of the roller bar excluding said smooth surfaces being provided with a large number of projections.

The aforementioned projections may be formed on the circumferential surface of the roller bar in such a manner that the tip ends thereof (the position of the tip ends in the radial direction of the roller bar) are flush with the circumferential surface of the roller bar, on in such a manner that the tip ends thereof (the position of the tips ends in the radial direction of the roller bar) are lower than the circumferential surface of the roller bar.

On the other hand, the aforementioned sliding bearing may be consisted of a plurality of short sliding bearings arrayed along the direction of axial line thereof. Alternatively, the aforementioned sliding bearing may be consisted of a plurality of short sliding bearings arrayed along the direction of axial line thereof, each being sustained by one end of each of plural holding members whose the other ends are respectively cantilevered on the knife stock.

It would be effective if the diameter of the roller bar is set to not more than 30 mm. It would be more effective if the position of the roller bar relative to the knife is set such that the roller bar is off-set in the direction orthogonal to the rotational direction of the log so as to come close to the log by a distance of 15% or more of a predetermined thickness of the veneer.

By the way, by the term "axial line" of the roller bar, it means an imaginary line connecting the rotational centers of the roller bar, i.e. an imaginary line connecting the rotational centers of various cross-sections orthogonal to the longitudinal direction of the roller bar.

DETAILED DESCRIPTION OF THE INVENTION

This invention will be further explained with reference various embodiments of this invention.

Figure 1:
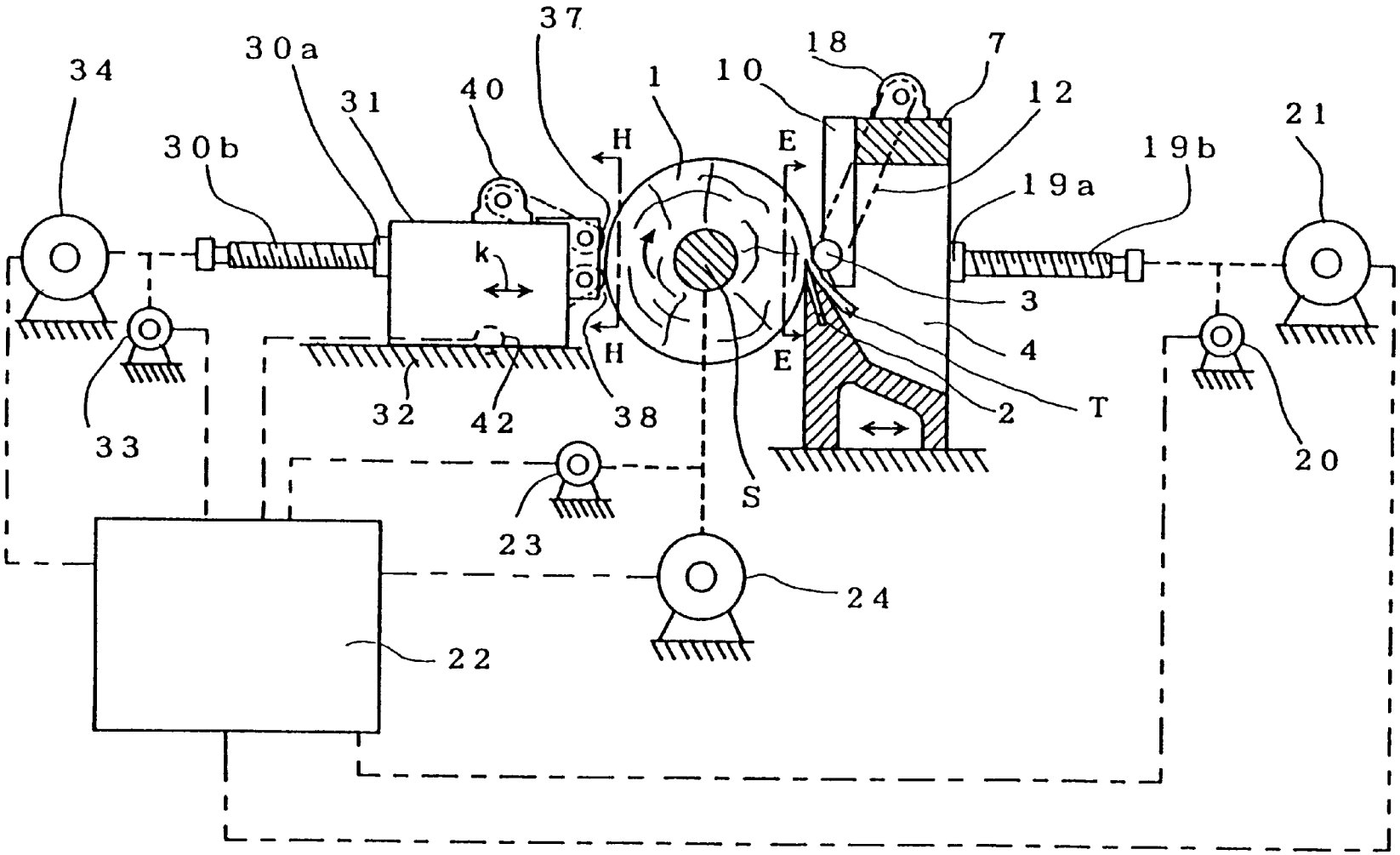
FIG. 1 is a side view schematically showing one example of a veneer lathe according to this invention.

As shown in FIG. 1, a veneer lathe essentially comprises a pair of spindles S which are adapted to move back and forth in the axial direction of a log 1, and a knife stock 4 which is provided with a knife 2 for peeling (or cutting) the log rotatably supported by the spindles S and with a roller bar 3.

Figure 2:
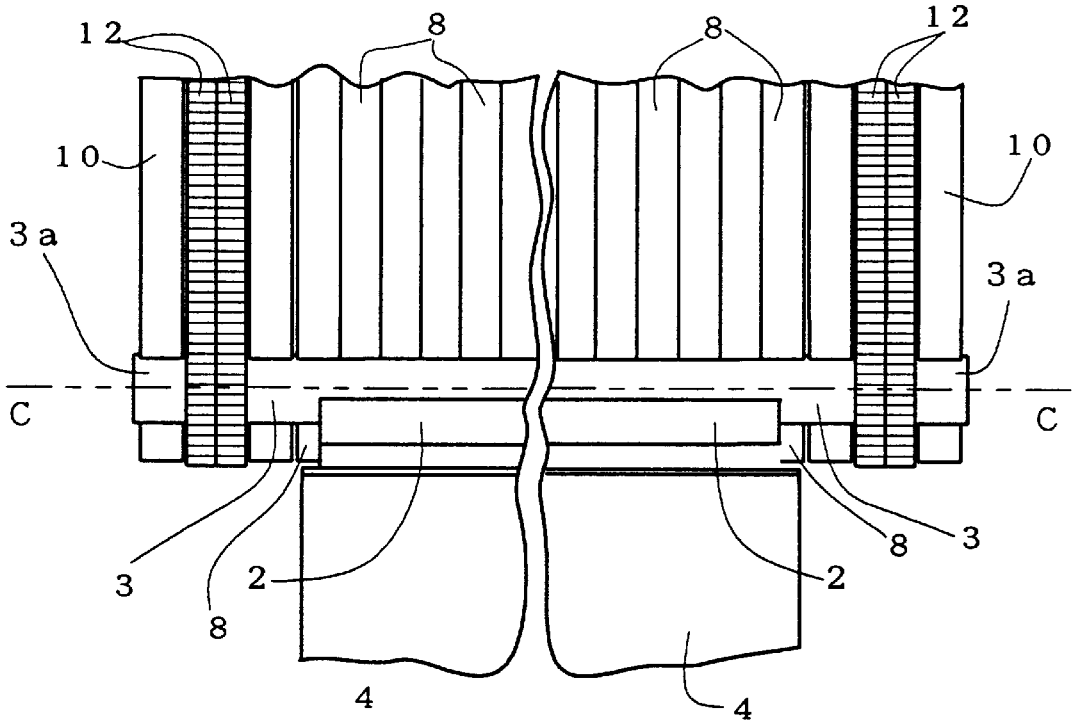
FIG. 2 is a front view as viewed from the direction of the dashed line E—E of FIG. 1 wherein a log 1 is omitted.
Figure 3:
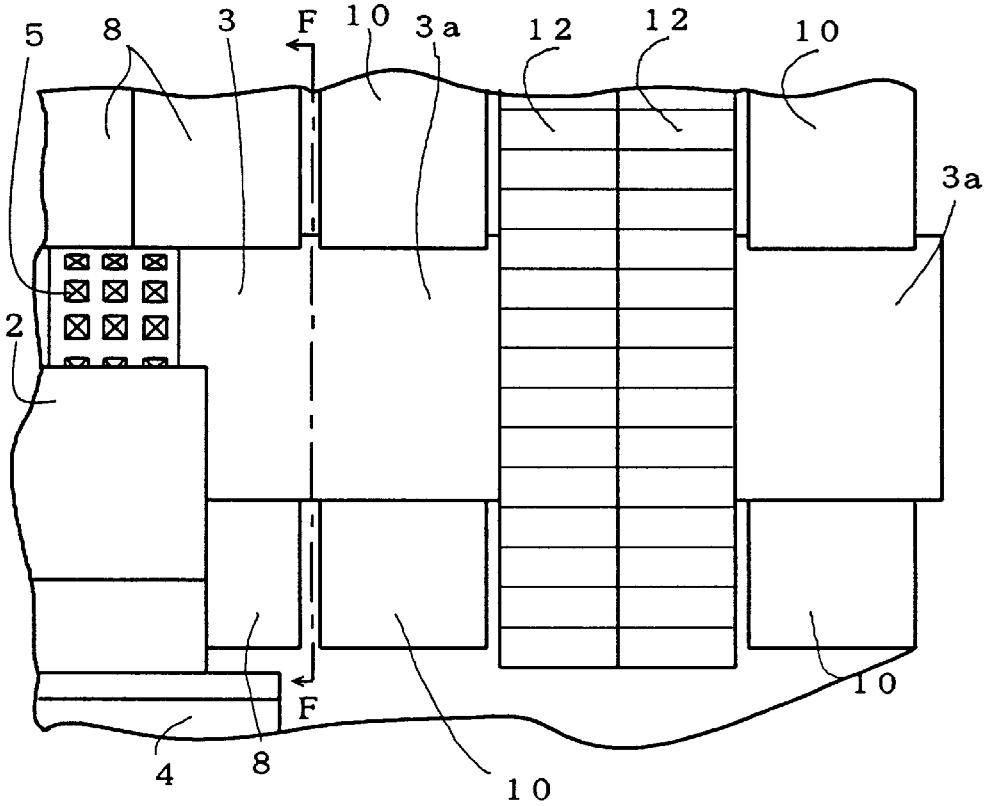
FIG. 3 is an enlarged front view illustrating the right side portion of FIG. 2.

As shown in FIG. 2 showing a front view from the direction of the dashed line E—E of FIG. 1 wherein a log 1 is omitted, and also in FIG. 3 showing an enlarged front view illustrating the right side portion of FIG. 2, the roller bar 3 and the cutting edge of the knife 2 are arranged parallel with each other.

Figure 4:
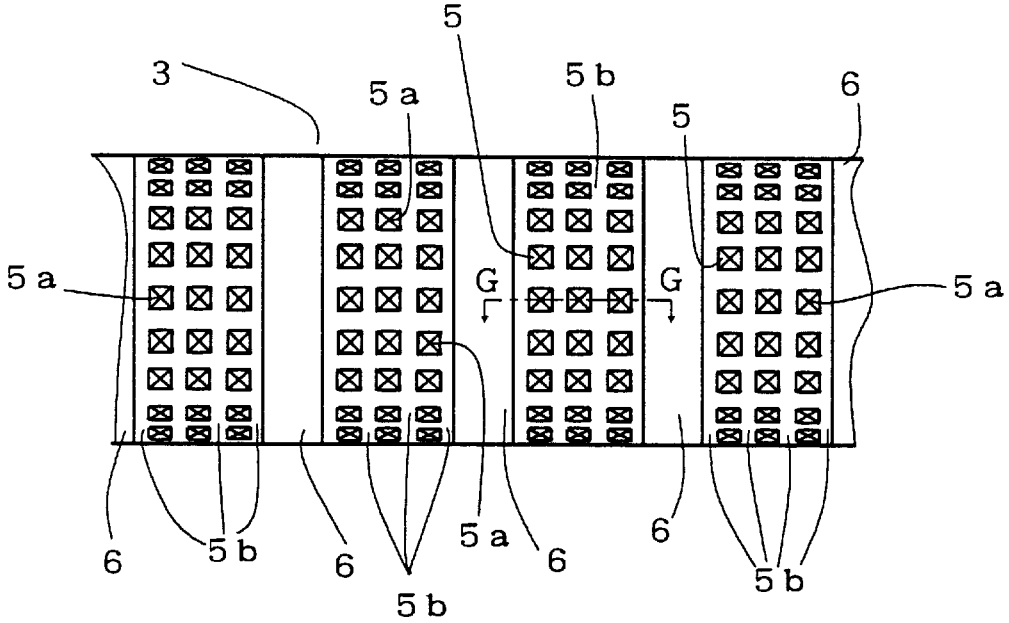
FIG. 4 is an enlarged front view illustrating a portion of the roller bar.

The roller bar 3 is provided with projections 5 to be explained hereinafter with reference to FIG. 4 showing a front view of the roller bar 3 of FIG. 3. Namely, the roller bar 3 is formed of a round bar having a diameter of 16 mm and provided on the circumferential surface thereof with a plurality of groups of array of projections 5, each group being spaced apart from each other along the axial direction of the roller bar 3 (a lateral direction in FIG. 4) as explained hereinafter and each projection having a shape of pyramid and formed by means of knurling. In this case, each group of array of projections 5 is consisted of three rows of projections 5 each row being spaced apart along the axial direction of the roller bar 3 as explained hereinafter from each other, and the projections 5 in each row which are sequentially formed along the rotational direction of the roller bar 3 are also spaced apart from each other by a distance which is identical with the distance between the rows.

By the way, by the term "axial line" of the roller bar 3, it means an imaginary line passing through the rotational center 3*b* of the roller bar 3 and being parallel with the roller bar 3. This "axial line" is indicated in FIG. 2 by a two dots and one dash line depicted between C—C.

Figure 5:
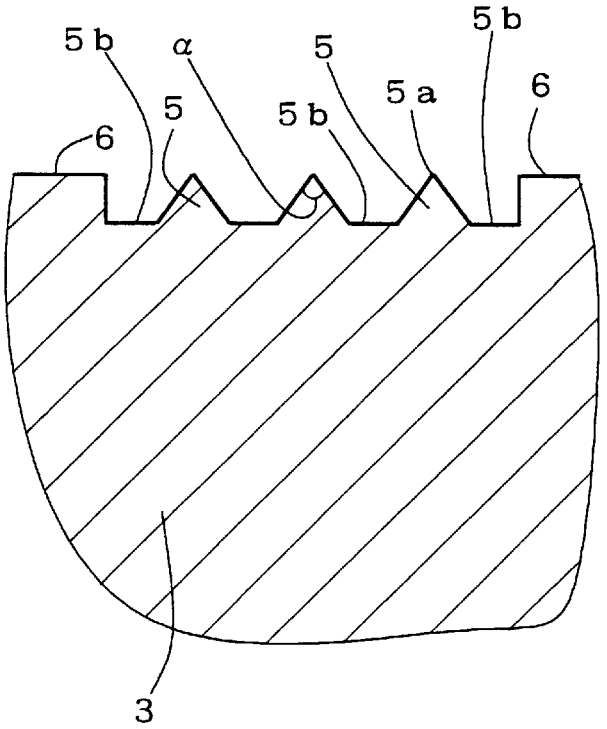
FIG. 5 is an enlarged view of the sectioned portion taken along the dashed line G—G shown in FIG. 4.

As shown in FIG. 5 illustrating an enlarged view of the sectioned portion taken along the dashed line G—G (a line passing through the tip end 5*a* of the projection 5 and being parallel with the axial line) shown in FIG. 4, each projection 5 is shaped such that the cross-section thereof is of an isosceles triangle having an angle of about 75 degrees at the tip end 5*a* (shown by $\alpha$) and a distance of about 1 mm between the tip end 5*a* and the bottom 5*b* thereof (a vertical distance or height in FIG. 5). The height of the tip end 5*a* of the projection 5 is flush with the level (in the radial direction) of the circumferential surface 6. The distance between neighboring tip ends 5*a* in the direction of the axial line (lateral direction in FIG. 5) is set to 2.5, and the length of the bottom 5*b* in the direction of the axial line is set to about 1 mm, so that the total width of each group of array of projections 5 consisted of three rows of projections 5 including four bottom portions 5*b* in the direction of the axial line is about 8.5 mm.

On the other hand, a smooth circumferential surface 6 is also contiguously formed along the rotational direction of the roller bar 3 with a width thereof being 3.5 mm in the direction of the axial line.

A holding member 8 which is provided with a sliding bearing 9 rotatably sustaining this roller bar 3 is constructed as explained below.

Namely, as shown in FIG. 1, a pressure bar table 7 is integrally mounted on the knife stock 4, and a large number of holding members 8 each having a predetermined width (35 mm for instance) are secured, in parallel with the cutting edge of the knife 2, to the pressure bar table 7, i.e. the upper portions of the holding members 8 being cantilevered on the pressure bar table 7. The lower portion of each holding member 8 is cut out in a circular shape, and each sliding bearing 9 is inserted into and secured to this circular cut-out portion as shown in FIG. 6 illustrating a perspective view thereof or as shown in FIG. 7 illustrating a partially sectioned view taken along the dashed line F—F of FIG. 3.

Figure 7:
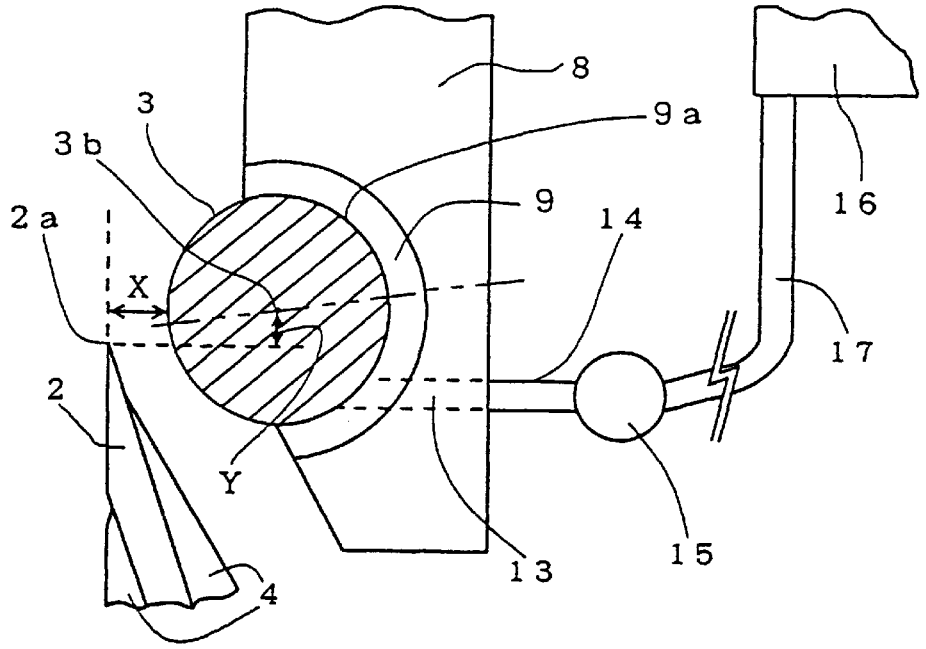
FIG. 7 is a partially sectioned view taken along the dashed line F—F shown in FIG. 3.

Each sliding bearing 9 is shaped such that the inner diameter thereof is large enough to house the roller bar 3 therein without substantially leaving a space therebetween, i.e. larger than 16 mm by a dimension of at most 0.1 mm, and that the cross-sectional shape (orthogonal to the axial line of the roller bar 3) thereof is semi-circular having an opening, e.g. on the left side in FIG. 7 wherein the length of the inner circumferential surface 11 of the groove portion 9*a* is set larger than a half of the circumferential length of the roller bar 3 so as to prevent the roller bar 3 held in each sliding bearing 9 from being ejected therefrom due to its own weight.

By the way, a through-hole to be employed as a water-feed passageway 13 as mentioned hereinafter is formed in the inner circumferential surface 11.

Figure 6:
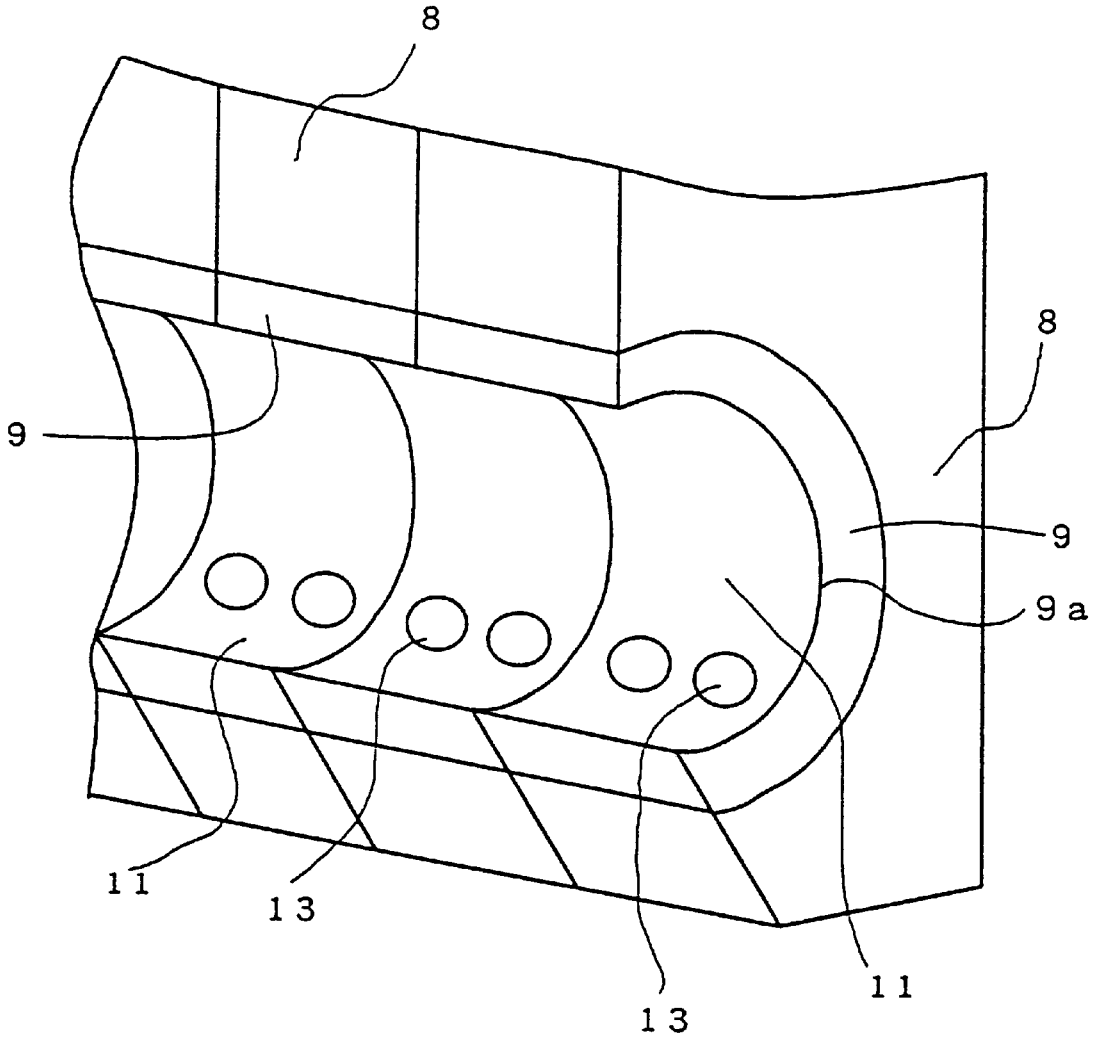
FIG. 6 is a partially enlarged perspective view of a holding member.

These holding members 8 are arranged side by side in a sufficient number so as to correspond to the length of a log to be peeled and in such a manner that the groove portions 9*a* of the bearing 9 neighboring to each other coincide with each other in vertical direction as well as in lateral direction of FIG. 7, and at the same time, are disposed parallel with the cutting edge of the knife 2 as shown in FIGS. 2 and 6. Under this condition, the roller bar 3 is introduced into the groove portion 9*a* from the right side of FIG. 6. Then, the fixing position of the roller bar 3 to the knife stock 4 is determined so as to set the roller bar 3 to a predetermined position in relative to the knife 2 as explained hereinafter.

Next, the position of the roller bar 3 relative to the knife 2 will be explained with reference to FIG. 7.

At first, the knife 2 is set to 22 degrees in edge angle and one degree in clearance angle for instance, and then the knife 2 is fixed onto the knife stock 4 in such a way that the cutting edge 2*a* of the knife 2 is kept at the same level as that of the pivot point of spindle S.

Under this condition, if a veneer having a thickness of 1 mm is to be peeled from a log, the position of the roller bar 3 relative to the knife 2 is set and fixed in such a way that the distance "X" between an imaginary cutting line by the knife 2, i.e. a dotted line extending perpendicularly from the cutting edge 2*a* as shown in FIG. 7 and a portion of the circumferential surface of the roller bar 3 which faces the dotted line is set to 80% of 1 mm, i.e. 0.8 mm, and that the distance "Y" between a dotted line extending horizontally from the cutting edge 2*a* as shown in FIG. 7 (hereinafter referred to as a horizontal cutting edge line) and the rotational center 3*b* of the roller bar 3 is set to 3.8 mm.

Further, the roller bar 3 is preferably arranged such that the rotational center 3*b* thereof can be moved along the two dots and one dash line shown in FIG. 7, which extends from the cutting edge 2*a* to pass through the rotational center 3*b* as the roller bar 3 is so positioned as to peel a veneer having a thickness of 1 mm and is slanted upward relative to the horizontal cutting edge line by an angle of about 11.30 degrees. Therefore, the holding member 8 mounted on the knife stock 4 is enabled to move reciprocatively. Since the structure for allowing this reciprocative motion is the same as that of the conventional veneer lathe, the explanation thereof is omitted herein.

Since the roller bar 3 is arranged in this manner, when the positional relationship between the roller bar 3 and the cutting edge 2*a* is desired to be changed in conformity with a change in thickness of veneer to be produced, e.g., if a veneer having a thickness of 6 mm is desired to be produced, the roller bar 3 can be shifted in the right upward direction (FIG. 7) along the aforementioned two dots and one dash line to an extent that the aforementioned distance X becomes 80% of 6 mm, i.e. 4.8 mm.

The shaft 3*a* on both end portions of the roller bar 3 is constructed as follows.

As shown in FIGS. 2 and 3, a couple of holders 10 each constructed in the same manner as that of the holding member 8 provided with the sliding bearing 9 are separately fixed onto the pressure bar table 7 so as to rotatably hold the shaft 3*a*. Further, a sprocket (not shown) is attached to an intermediate portion of the shaft 3*a* between the couple of the holders 10. This sprocket is engaged with a chain 12 which is adapted to be driven by a motor 18 provided with a torque limiter for limiting a torque to be transmitted. With this sprocket, the roller bar 3 is designed to be rotated always at a peripheral speed of 60 m per minute.

Further, as shown in FIG. 7, each holding member 8 is provided with a large number of water-feeding passageways (hereinafter referred to as passageways) 13, each passageway extending from the back surface of the holding member 8 to the inner peripheral wall 11 with which the roller bar 3 disposed inside the groove portion 9*a* is contacted. Each passageway 13 is connected with a tube 14 as shown in FIG. 7. Each tube 14 is communicated with a pipe 15 having closed ends and extending, in parallel with the cutting edge of the knife 2, throughout almost the whole length of the holding members 8. The pipe 15 is communicated via a tube 17 with a water tank 16 disposed higher than the piper 15, so that the groove portion 9*a* is always supplied with water due to the gravitational force of water from the tank 16.

As shown in FIG. 1, a couple of female screws 19*a* which are spaced apart from each other in the direction orthogonal to the moving direction of the knife stock 4 are fixed as a first shifting mechanism to the knife stock 4, each female screw being engaged with a male screw 19*b*. On the other hand, as a log diameter-detecting mechanism for detecting the radius of the log 1, a detection 20 comprising a rotary encoder which is designed to count the number of rotations of the male screw 19*b* whereby to detect the distance between the rotational center of the log 1 and the cutting edge of knife 2 is attached to the male screw 19*b*. Further, a variable speed driving source 21 comprising a servo-motor for rotating the male screw 19*b* is attached to the male screw 19*b*.

When the male screw 19*b* is rotated by means of the variable speed during source 21 according to the controlling by a controlling mechanism 22 to be explained hereinafter, the knife stock 4 is caused to move leftward of FIG. 1 at a desired or predetermined velocity at the occasion of peeling a log, or to move rightward when the peeling is finished thereby to return to the original position.

A couple of spindles S are adapted to move back and forth against the log 1 by means of a hydraulic cylinder (not shown) acting as a spindle actuating mechanism. As shown in FIG. 1, the spindle S is provided with a center driving device comprising a revolution counter 23 consisting a rotary encoder, etc. for counting the number of revolution per unit time of the spindle S, and a variable speed driving source 24 consisting a DC motor, etc. for rotating the spindle S.

The spindle S thus constructed is adapted to be controlled such that the log 1 can be rotated always at the same peripheral speed thereby to peel a veneer T with the knife 2 even if the diameter of log 1 is decreased as the knife stock 4 is moved toward the log 1 and the log 1 is peeled by the knife 2, i.e. the spindle S is controlled, by means of a controlling mechanism 22 which is designed to receive signals from the detector 20, such that the number of revolution of the spindle S increases in conformity with a change in distance between the rotational center of the log 1 and the cutting edge of the knife 2. Further, the spindle S is designed to supply, through the core portion of the log, part of the driving power required for the peeling of the log 1. By the way, the aforementioned peripheral speed of log 1 is set to become lower than the peripheral speed of the roller bar 3 (for example, 58 m per minute).

On the other hand, as shown in FIG. 1, a couple of male screws 30*b* which are spaced apart from each other in the direction orthogonal to the moving direction of the knife stock 4 are disposed as a second shifting mechanism at a position which is symmetrical, with the spindle S being disposed at the center, to the aforementioned male screws 19*b*.

Figure 8:
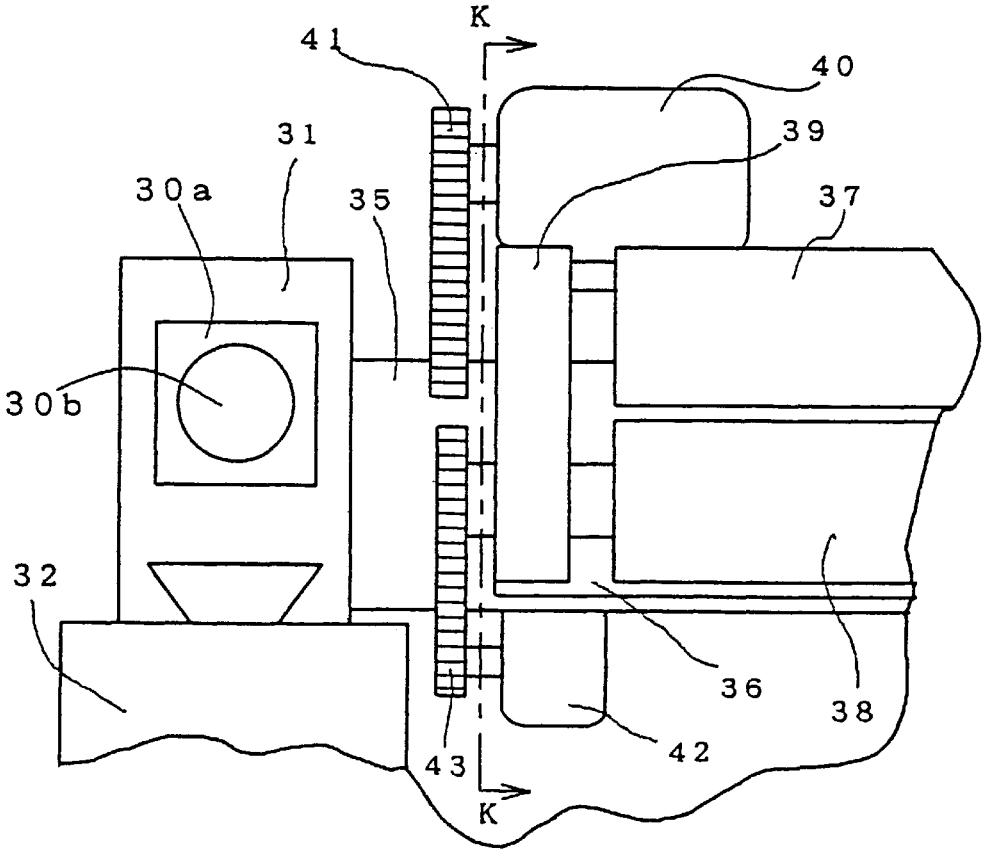
FIG. 8 is a front view as viewed from the direction of the dashed line H—H of FIG. 1 wherein a log 1 is omitted.

This couple of male screws 30*b* are engaged respectively with a female screw 30*a* which is attached to a supporting stand 31. As shown in FIG. 8 illustrating a front view as viewed from the direction of the dashed line H—H of FIG. 1 wherein a log 1 is omitted, each supporting stand 31 is engaged through a dovetail with a base 32 which is disposed horizontally, so that each supporting stand 31 is allowed to move linearly and horizontally, i.e. each supporting stand 31 is designed to be guided to move in the direction of K (lateral direction) shown in FIG. 1.

Further, as shown in FIG. 1, each supporting stand 31 is connected with a detector 33 comprising a rotary encoder for detecting the distance between the rotational center of the log 1 and the circumferential surfaces of rolls 37 and 38 to be explained hereinafter, and with a variable speed driving source 34 comprising a servo-motor.

Figure 9:
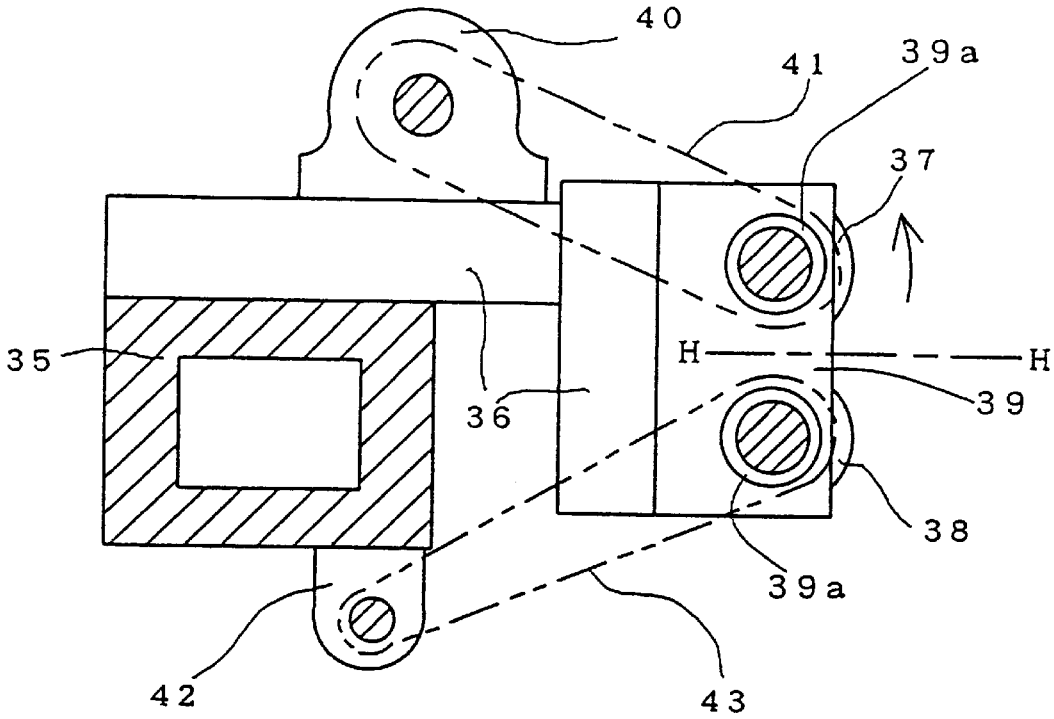
FIG. 9 is a partially sectioned view taken along the dashed line K—K shown in FIG. 8.

On the other hand, as shown in FIG. 8 as well as in FIG. 9 illustrating a partially sectioned view taken along the dashed line K—K of FIG. 8, a square hollow columnar mounting base member 35 is disposed between the couple of the supporting stands 31 and fixed, through its both ends, to the supporting stands 31.

As clearly seen from FIG. 9, a holding member 36 which is L-shaped in side view and whose length in the direction orthogonal to the moving direction of the supporting stands 31 is shorter than that of the columnar mounting base member 35 is fixedly mounted near the center between the supporting stands 31. By the way, as shown in FIG. 8, the holding member 36 is disposed so as not to interfere with the movements of a chain 41 and of a timing belt 43 as explained hereinafter.

As shown in FIGS. 8 and 9, a supporting board 39 is secured to the holding member 36. A couple of rolls 37 and 38 each having an axial length slightly longer than the log 1 to be peeled are rotatably held through both end portions by bearings 39*a* mounted on this supporting board 39.

These rolls 37 and 38 are positioned such that an imaginary horizontal line H—H indicated by a dashed line in FIG. 9 and passing through the rotational center of the log 1 passes through a middle point between the couple of rolls 37 and 38. In this example, the diameter of each roll 37 or 38 is set to 115 mm, while the distance between the rotational centers of these rolls 37 and 38 is set to 145 mm.

As shown in FIGS. 8 and 9, a motor 40 is mounted on the surface of the holding member 36. The rotation of the motor 40 is transmitted through a chain 41 (shown in two dots and one dash in FIG. 9) to the roll 37. In this case, the roll 37 is designed to rotate always in the direction indicated by the arrow at a peripheral speed which is set slightly higher than the peripheral speed of the roller bar 3 (for example, 62 m per minute).

A pulse counter 42 for counting the pulse to be generated at the every rotation of an axis is mounted as a revolution-counting mechanism on the bottom surface of the mounting base member 35. A toothed gear (not shown) is mounted on the shaft of the pulse counter 42 as well as on the shaft of the roll 38. A timing belt 43 (shown as a two dots and one dash line in FIG. 9) is would around both of these gears so as to transmit the rotation of the roll 38 to the pulse counter 42.

The signal of rotation of the roll 38 which has been transmitted to the pulse counter 42 is then transmitted to the control mechanism 22, thus making it possible to count the number of revolutions per unit time of the log 1 by also taking account of the information of signal from the detector 20 as explained below.

When the male screw 30*b* is rotated by means of the variable speed driving source 34 according to the controlling by a controlling mechanism 22 to be explained hereinafter, the rolls 37 and 38 mounted on the supporting stand 31 are caused to move in the direction indicated by the arrow shown in FIG. 1 at a desired or predetermined velocity.

The controlling mechanism 22 is designed to control each member as explained below.

Namely, at the moment of starting the peeling of the log 1, the male screw 30*b* is rotated so as to move the supporting stand 31 away from the log 1 thereby keeping the rolls 37 and 38 away from the log 1, while allowing only the spindle S to contact with the log thereby to rotate the log 1. Based on this rotation, the number of revolutions per unit time of the spindle S or the log 1 is calculated by the revolution counter 23, and the signal thereof is received by the controlling mechanism 22. Then, based on this signal, the controlling mechanism 22 is actuated to transmit an operation signal (hereinafter referred to as a first operation signal) to the variable speed driving source 21 so as to move the knife stock 4 in such a way that enables a desired constant thickness (for example 6 mm) of the veneer to be obtained, i.e. to cause the knife stock 4 to move toward the log 1 at a ratio of 6 mm per rotation of the log 1.

When the peeling of the log is initiated to produce a contiguous strip-like veneer from the log 1, a signal is input manually by an operator to the controlling mechanism 22, whereby the variable speed driving source 34 is actuated so as to move the supporting stand 31 toward the log 1 at a velocity which is faster than that of the knife stock 4. Once the supporting stand 31 is moved to a position where the distance between the rotational center of the log 1 and the circumferential surfaces of rolls 37 and 38 that can be detected from the detector 33 becomes identical with the distance between the rotational center of the log 1 and the cutting edge of the knife 2 that can be obtained from the detector 20 (strictly speaking, a position on the Archimedes' spiral curve taking the thickness of veneer into consideration), a signal to control the supporting stand 31 to move toward the log 1 in the same velocity as that of the knife stock 4 thereafter is transmitted to the variable speed driving source 34. As a result, the rolls 37 and 38 are moved toward the rotational center of the log 1 while they are always kept pressed onto the circumferential surface of the log 1 being reduced in diameter as it is peeled.

The roll 38 which is press-contacted with the log 1 is forced to be driven following the rotation of the log 1, and the rotation of this roll 38, i.e. the peripheral speed of the log 1 is transmitted via the timing belt 43 to the pulse counter 42. From this signal together with an additional signal on the gradually changing distance between the rotational center of the log 1 and the cutting edge of the knife 2, the number of revolutions per unit time of the log 1 is calculated every predetermined very short period of time that has been set in advance by the control mechanism 22. Then, based on this number of revolutions thus calculated, a signal for moving the knife stock 4 toward the log 1 at a speed of 6 mm per every rotation of the log 1 at each number of revolution calculated above (hereinafter referred to as a second operation signal) is calculated by the control mechanism 22. At this moment however, the first operation signal is still transmitted to the variable speed driving source 21 and this second operation signal is not yet transmitted to the variable speed driving source 21.

When the peeling work is further advanced from the aforementioned state to such an extent that a signal from the detector 20 informing that the distance between the rotational center of the log 1 and the cutting edge of the knife 2 (which can be assumed as a radius of the log) becomes a predetermined dimension (hereinafter referred to as a first distance) which is slightly larger than the radius of the spindle S (for example, 60 mm) is detected, the control mechanism 22 is actuated to switch the signal to be supplied to the variable speed driving source 21 from the first operation signal which has been initially employed for moving the knife stock 4 to the second operation signal on the basis of which the movement of the knife stock 4 is further continued. After these operation signals are switched in this manner, a signal for moving back the spindle S to separate it from the log 1 is emitted.

When the peeling work is further advanced from the aforementioned state to such an extent that the detector 20 indicates that the distance between the rotational center of the log 1 and the cutting edge of the knife 2 becomes a predetermined dimension (hereinafter referred to as a second distance) (for example, 40 mm), an operation stop signal is transmitted from the control mechanism 22 to the variable speed driving source 21 as well as to the variable speed driving source 34, whereby the movements of the knife stock 4 and the rolls 37 and 38 toward the log 1 are stopped, and then the knife stock 4 and the rolls 37 and 38 moved away from the log.

The followings are the effects of operation that can be resulted from the aforementioned embodiment of this invention.

At the start of the peeling, the rolls 7 and 38 are kept away from the log, thus allowing only the spindle S to contact with the log 1 so as to rotate the log 1. The control mechanism 22 receives signals from the rotation counter 23 and, based on the signals, transmits the first operation signal to the variable speed driving source 21 so as to move the knife stock 4 i such a way that a constant thickness of veneer is assured. As mentioned above, since the spindle S is controlled to increase the number of revolutions thereof in conformity with a change in distance between the rotation center of the log 1 and the cutting edge of the knife 2, the number of revolution per unit time of the spindle S increases with the movement of the knife stock 4 toward the log 1.

Subsequently, the circumferential surface of the roller bar 3 is pressed onto the circumferential surface of the log 1. Since a torque limiter is attached to a motor employed for rotating the roller bar as mentioned above, the peripheral speed of the roller bar 3 is restricted as it is contacted with the log 1, thus becoming almost the same as the peripheral speed of the log 1. A driving force is supplied to the log 1 from the roller bar 3 and also from the spindle S so as to initiate the peeling of log 1 by the knife 2 to produce a veneer.

Figure 10:
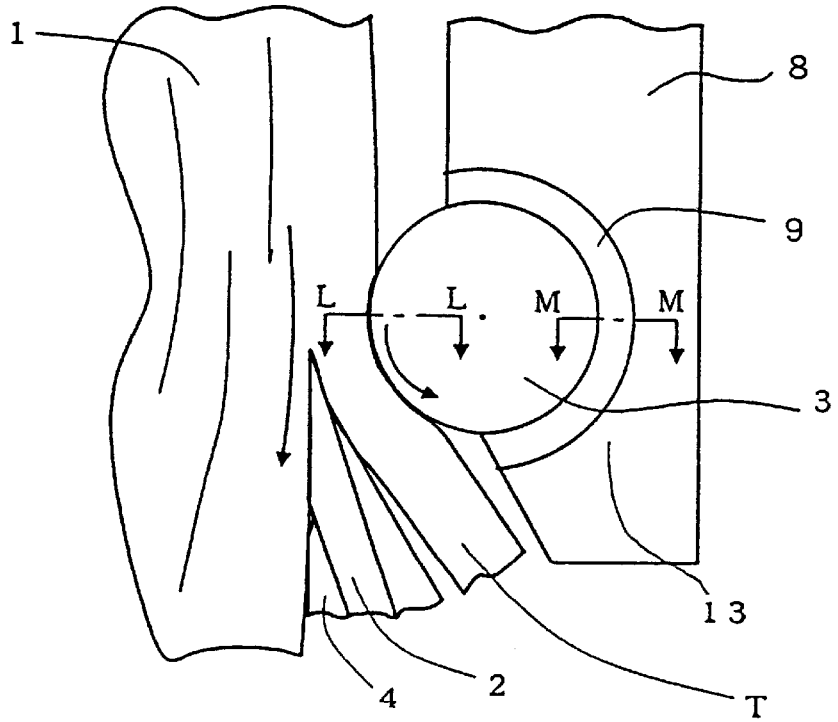
FIG. 10 is an enlarged side view illustrating the knife 2 and the roller bar 3 shown in FIG. 1.

This peeling is performed as shown in FIG. 10 illustrating the peeling state of log 1 in a position which is the same as that shown in FIG. 7 and also illustrating a region around the roller bar 3, thus obtaining a veneer T.

Figure 11:
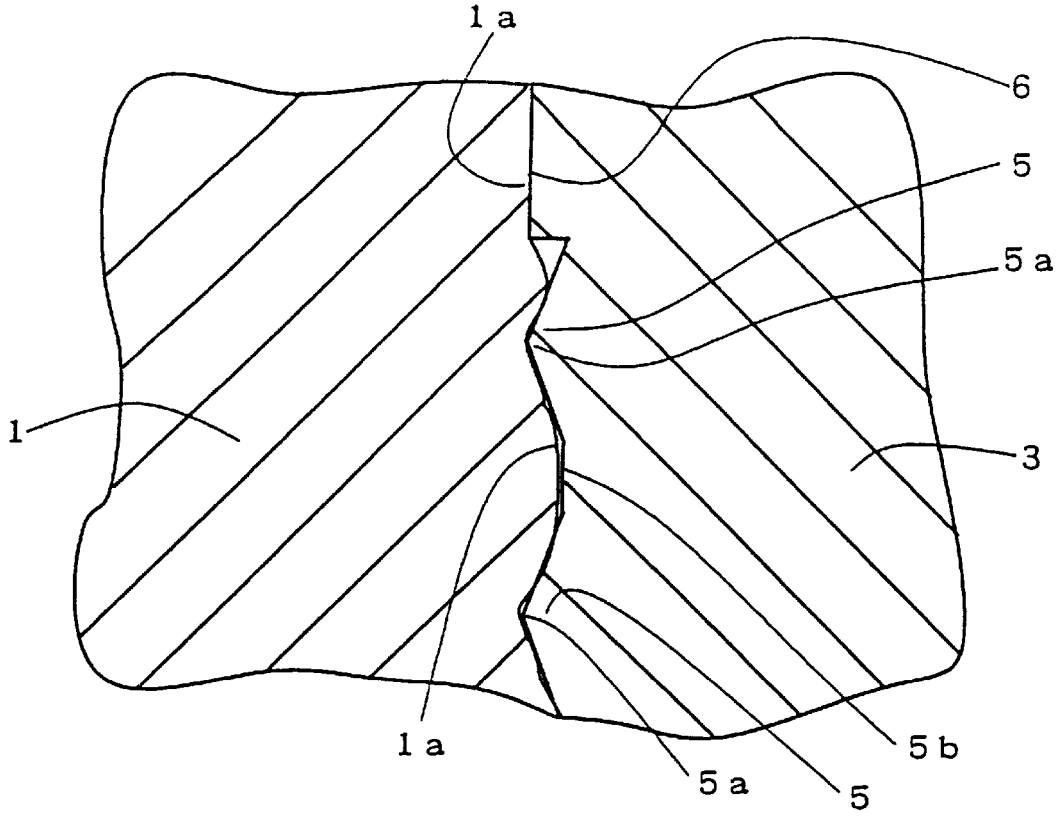
FIG. 11 is an enlarged sectional view taken along the dashed line L—L shown in FIG. 10.

As illustrated above with reference to FIG. 7, since the log 1 is deformed through a compression by the roller bar 3 which has been set such that the distance X becomes 80% of the veneer to be produced, the tip end 5*a* of the projection 5 is caused to penetrate into the circumferential surface 1*a* of the log 1 as shown in FIG. 11 illustrating a sectional view taken along the dashed line L—L of FIG. 10. Therefore, the log 1 is forced to rotate by the roller bar 3 under a condition where the circumferential surface 1*a* of the log 1 is caught by the projections 5, thus making it possible to transmit a larger force from the roller bar 3 to the log 1 as compared with the case where the roller bar is entirely formed of a smooth surface.

Furthermore, since the distance in radial direction between the bottom 5*b* of the projection 5 to the tip end 5*a* is set to as short as about 1 mm, an excessive penetration (or biting) of the tip end 5*a* into the circumferential surface of log 1 can be avoided. Therefore, a flaw to be formed on the surface of the produced veneer T facing the roller bar 3 is minimal, so that the quality of product such as a plywood that is to be manufactured using this veneer T would not be substantially deteriorated.

Furthermore, since the diameter of the roller bar 3 is as small as 16 mm, it becomes possible to press the log at a position immediately before the knife 2 by making use of the smooth surface 6 and the projections 5 of the roller bar 3 as shown in FIG. 10, so that a veneer T which is minimal in lathe check can be obtained.

Figure 12:
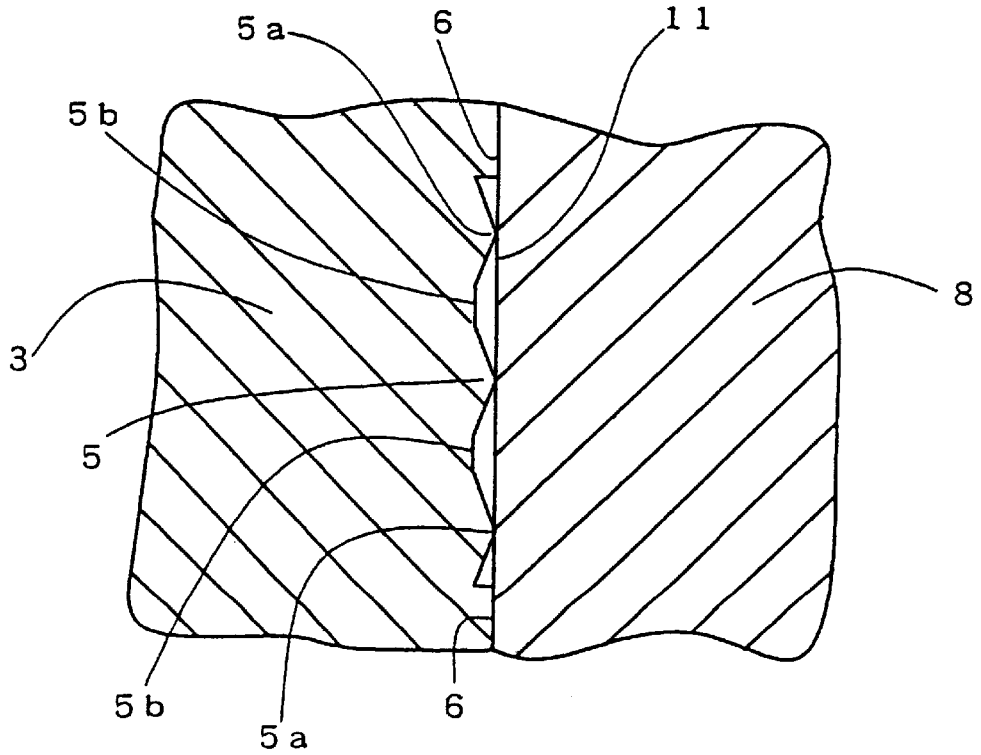
FIG. 12 is an enlarged sectional view taken along the dashed line M—M shown in FIG. 10.

On the other hand, with regard to the relationship between the roller bar 3 and the holding member 8, the smooth circumferential surface 6 of the roller bar 3 is contacted with the inner wall 11 of the holding member 8 as shown in FIG. 12 illustrating a sectional view taken along the dashed line M—M of FIG. 10. Therefore, there is little possibility that part of the inner wall 11 contacting with the smooth circumferential surface 6 is erased as in the case of the roller bar 56 to be explained hereinafter with reference to FIG. 17 even if the roller bar 3 is rotated. Even is part of the inner wall 11 contacting with the tip end 5*a* of the projection 5 is erased by this tip end 5*a,* the roller bar 3 as a whole can be maintained in place which has been initially set owing to the portion of the inner wall 11 which is being contacted with the smooth circumferential surface 6, thus making it possible, under a desired condition, to obtain a veneer T excellent in quality.

Further, since water is always supplied to the groove portion 9*a* from the tank 16, the inner wall 11 as well as the circumferential surface of the roller bar 3 can be entirely wetted with water introduced into the groove portion of roller bar 3 through the rotation of the roller bar 3. The water introduced in this manner functions as a lubricant and also as a coolant in the rotation of roller bar 3 which is kept in place by the inner wall 11 of the holding member 8.

When it is confirmed by the visual observation by an operator that the peeling is proceeded continuously producing a contiguous strip-like veneer T from the log, a signal is transmitted manually by the operator to the control mechanism 22. Upon receiving the signal, the control mechanism 22 is actuated to send a signal to various members so as to actuate these members as explained below.

Namely, the variable speed driving source 34 is actuated to move the supporting stand 31 toward the log 1 at a speed which is faster than the moving speed of the knife stock 4. When it is confirmed by the detectors 33 and 20 that the supporting stand 31 is moved to a position were the distance between the rotational center of the log 1 and the circumferential surfaces of rolls 37 and 38 becomes identical with the distance between the rotational center of the log 1 and the cutting edge of the knife 2, so that the rolls 37 and 38 are rendered to press-contact with the circumferential surface of the log 1, the supporting stand 31 is rendered to move, while keeping the rolls 37 and 38 press-contacted with the circumferential surface of the log 1, toward the rotational center of the log 1 at the same speed as that of the knife stock 4.

Since the rolls 37 and 38 are press-contacted with the circumferential surface of the log 1, it is possible to prevent the log 1 from being bent by the horizontal force of the knife 2 applied to the log 1 even if the diameter of the log 1 becomes smaller due to the peeling thereof. Further, since the peripheral velocity of the roll 37 is preliminarily set in a manner as mentioned above, a force in the rotational direction of the log 1 is given from the roll 37 to the log 1 while allowing the roll 37 to slip over the circumferential surface of the log 1, whereby supplying part of driving force required for peeling the log.

When the peeling work is further advanced from the aforementioned state to such an extent that a signal is received from the detector 20 indicating that the distance between the rotational center of the log 1 and the cutting edge of the knife 2 became the aforementioned first distance, the control mechanism 22 is actuated to switch the signal to be supplied to the variable speed driving source 21 from the first operation signal which has been initially employed for moving the knife stock 4 to the second operation signal on the basis of which the movement of the knife stock 4 is further continued. Thereafter, in response to an operation signal from the control mechanism 22, the spindle S is move backward so as to be separated from the log 1.

Figure 13:
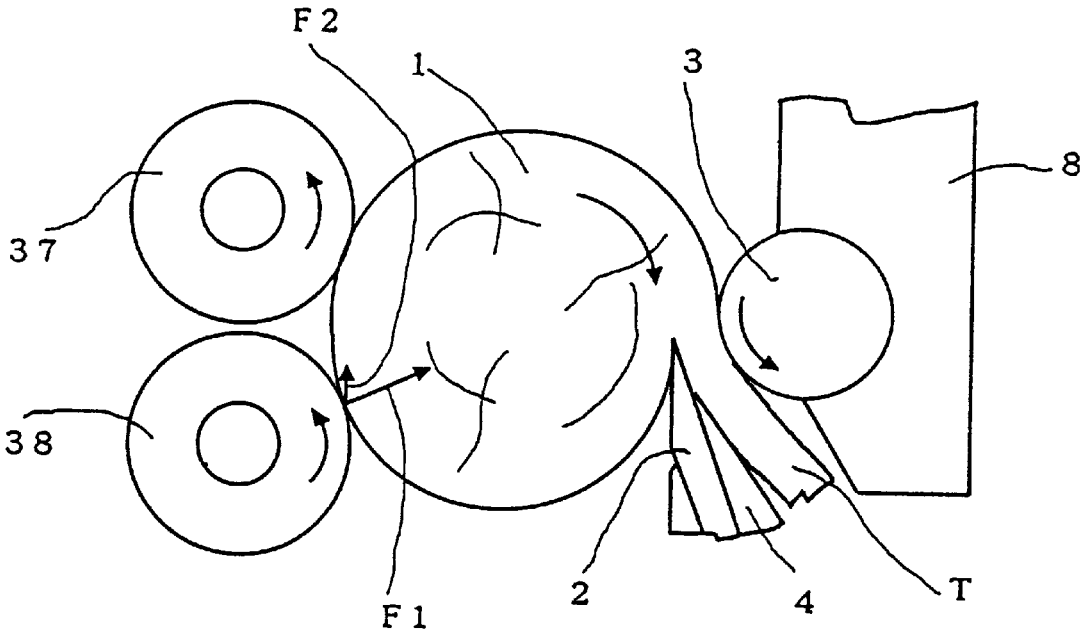
FIG. 13 is an enlarged sectional view illustrating a state wherein a spindle is detached from a log.

As shown in FIG. 13, since a force directed toward the rotational center of the log 1 from the roll 38, i.e. the force "F1" inclined upward is acted on the log 1 and hence a force "F2" which is perpendicular to the force "F1" is effected as a main force on the log 1, the log 1 is prevented from falling even if the spindle S is set back from the log 1. Namely, the log 1 is rotatably sustained between the roller bar 3 and the rolls 37 and 38, thus making it possible to continue the peeling of the log 1 with the knife 2.

When the peeling work is further advanced from the aforementioned state to such an extent that the detector 20 indicates that the distance between the rotational center of the log 1 and the cutting edge of the knife 2 becomes the aforementioned second distance, a stop signal is transmitted from the control mechanism 22 and hence the rotation of both male screws 19*b* and 30*b* are stopped, thus also stopping the movements of the knife stock 4 and the rolls 37 and 38 toward the log 1. Subsequently, when the male screws 19*b* and 30*b* are rotated in the reverse direction so as to move the knife stock 4 and the rolls 37 and 38 away from the log 1, the residual round rod-like log 1 called "peeled core" is allowed to fall due to its own weight.

The aforementioned procedures are repeated to perform the peeling of the log 1.

In the aforementioned embodiment according to this invention, the roller bar 3 functions not only as a pressure bar but also as a driving force-transmitting medium for transmitting at least part of driving force required for the peeling of log to the log.

In the aforementioned embodiment, the diameter of the roller bar is set to 16 mm. However, as long as the diameter of the roller bar is not more than 30 mm, it is possible to apply the roller bar to a position immediately before the knife so as to effectively press the log, thus enabling the roller bar to function as a pressure bar and also as a medium to transmit a driving force to the log. Further, if the thickness of veneer to be produced is relatively thick, e.g. 10 mm or so, it may be more preferable to set the diameter of the roller bar to 20 mm or so. Whereas, if the thickness of veneer to be produced is relatively thin, e.g. no more than 5 mm, it may be more preferable to set the diameter of the roller bar to 16 mm or so.

With regard to the position of the roller bar relative to the knife, if the distance in the direction orthogonal to the rotating direction of the log, i.e. the distance X shown in FIG. 7 is selected to be not more than 85% of the thickness of veneer to be produced, a veneer which is minimal in lathe check can be obtained.

The aforementioned manufacturing conditions are all based on the experiments performed by the prevent inventor as evident from the results of experiments shown in the following Table 1, and hence are well-grounded.

TABLE 1

| | X in FIG. 7 (ratio (%) to the thickness of veneer) | | | |
|---|---|---|---|---|
| B | 80 | 85 | 90 | 95 |
| 16 | ○ | ○ | Δ | X |
| 20 | ○ | ○ | Δ | X |
| 25 | ○ | ○ | Δ | X |
| 30 | ○ | ○ | Δ | X |
| 40 | Δ | Δ | Δ | X |

(Note)
B: The diameter of the roller bar (mm)
○: Minimal in lathe check and the surface of veneer is also minimal in roughness
Δ: More or less prominent in lathe check and the surface of veneer is also somewhat prominent in roughness
X: Prominent in lathe check and the surface of veneer is also Prominent in roughness.

The aforementioned embodiment may be modified as follows.

Figure 14:
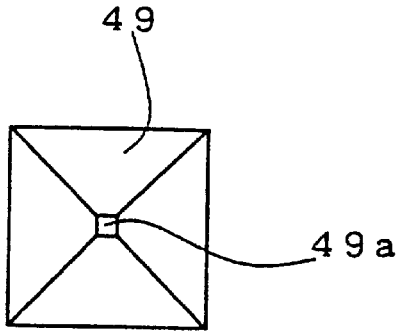
FIG. 14 is a plan view showing a modified example of a projection constituting the circumferential surface of the roller bar.

1. The tip end 5*a* of the projection 5 formed on the roller bar 3 may not necessarily be sharp as shown in the aforementioned embodiment. For example, as shown in FIG. 14 were only one projection is shown as an enlarged view in correspondence to FIG. 4, the tip end 49*a* of projection 49 may be of an erased shape having a flat square 0.5 mm×0.5 mm in size. Even if the projection 49 is shaped in this manner, it is possible to cause the tip end 49*a* to penetrate into the circumferential surface of the log 1, and hence a sufficient driving force can be transmitted from the roller bar to the log. Moreover, when the projection 49 is shaped in this manner, the flaw that might be formed on the surface of the veneer facing the roller bar can be further minimized.

Figure 15:
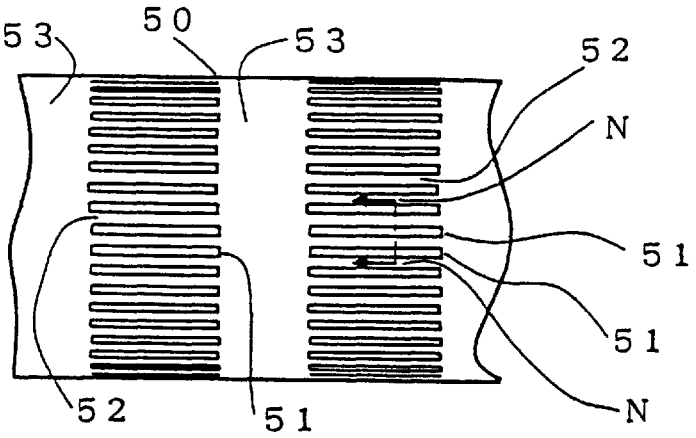
FIG. 15 is a front view illustrating a modified example of a roller bar.
Figure 16:
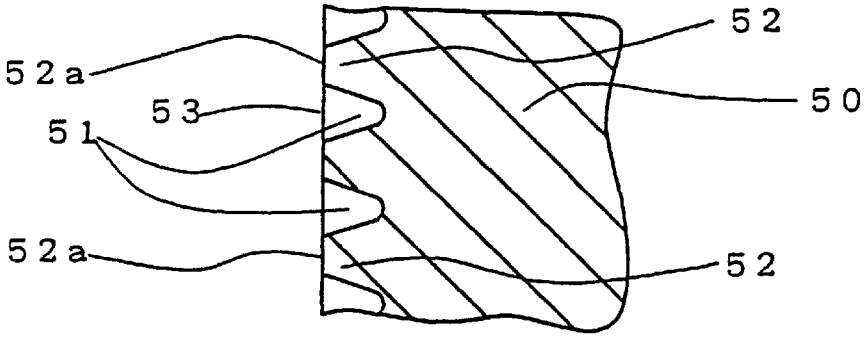
FIG. 16 is an enlarged sectional view taken along the dashed line N—N shown in FIG. 15.

2. The projections to be formed on the circumferential surface of the roller bar may be shaped as shown in FIG. 15. Namely, this roller bar 50 has a diameter which is the same as that of the roller bar 3, and is sustained in the holding member 8. This roller bar 50 is provided on its circumferential surface with a large number of grooves 51 which are sequentially formed along the rotation direction with neighboring grooves 51 being spaced apart from each other at constant intervals. These grooves 51 may be formed by means of knurling. As shown in FIG. 16 illustrating a sectional view taken along the dashed line N—N of FIG. 15, the tip end 52*a* of the projection 52 constitutes a flat smooth peripheral surface. Namely, the level of the tip 52*a* in radial direction of roller bar 50 is flush with the smooth circumferential surface 53 of the roller bar 50.

If the projection 52 is shaped in this manner, it is possible, as in the cases of the projection 5 or the projection 49, to case the tip end 52*a* to penetrate into the circumferential surface of the log 1, and hence a sufficient driving force can be transmitted from the roller bar 52 to the log 1. Moreover, since smooth circumferential surfaces 53 are formed along the direction of axial line of the roller bar 50 or along the lateral direction of FIG. 15, it is possible to prevent the projections 52 from being excessively penetrated into the circumferential surface of the log 1. Further, it is possible with this roller bar 50 to press the log 1 by means of the circumferential surface 53 and the projections 52 at a position immediately before the knife 2. Additionally, at the side where a portion of the roller bar is contacted with the inner wall 11 of the holding member 8, the smooth circumferential surface 53 is kept in place by the inner wall 11, so that the roller bar 50 can be desirably maintained in place as a whole, thereby making it possible to obtain a veneer excellent in quality.

3. In the case of a roller bar having the same diameter as that of the roller bar 3 and being adapted to be sustained in the holding member 8 in the same manner as the roller bar 3, the projections to be formed on the circumferential surface of the roller bar may be shaped as follow.

Figure 17:
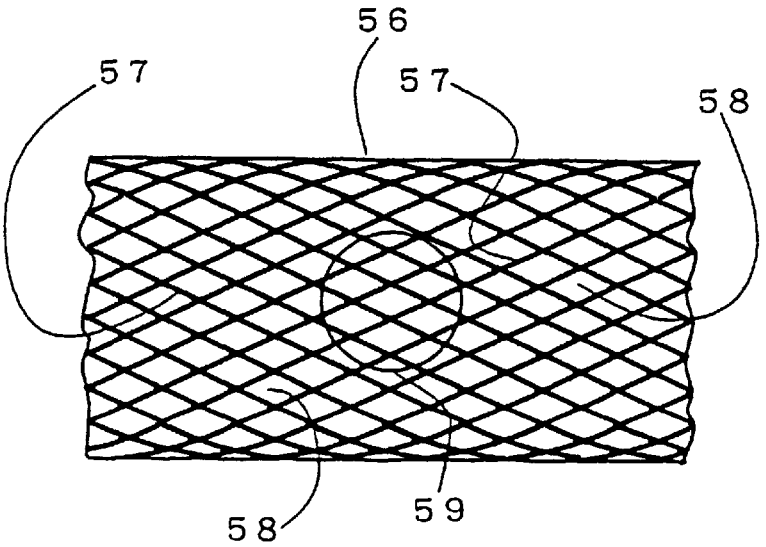
FIG. 17 is a front view illustrating a modified example of a roller bar.

Namely, as shown in FIG. 17, two groups of grooves each inclined in opposite direction so as to intersect to each other thereby forming a large number of rhomboidal projections 58, each constituting a smooth circumferential surface 58*a*, are spirally formed around the circumferential surface of the roller bar 56. More specifically, each group of grooves is constituted by a large number of parallel grooves 57, each having a depth of 0.5 mm and a width of 0.5 mm and being spaced apart from the neighboring grooves by a distance of 3 mm and inclined at an angle of 15 degrees to the axial line of the roller bar 56.

Figure 18:
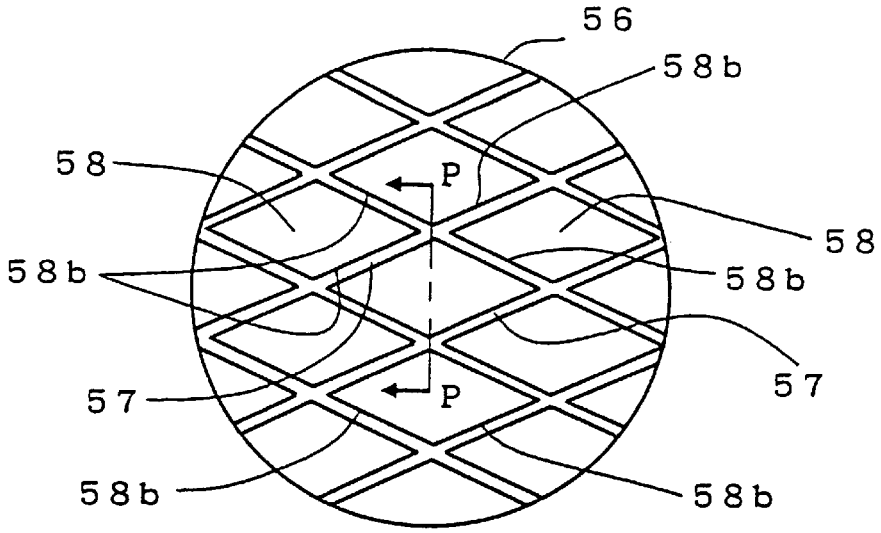
FIG. 18 is an enlarged view illustrating an encircled portion 59 shown in FIG. 17.
Figure 19:
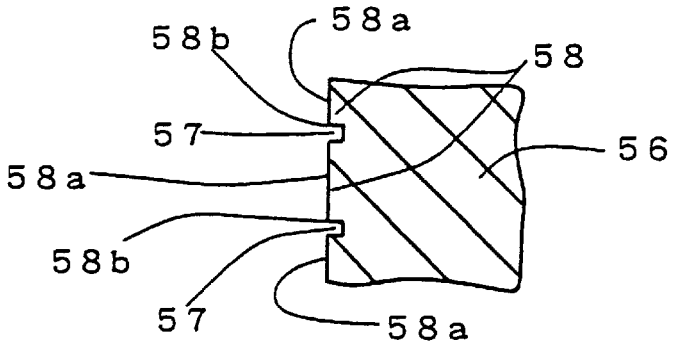
FIG. 19 is an enlarged sectional view taken along the dashed line P—P shown in FIG. 18.

FIG. 18 shows an enlarged view of the circled portion 59 shown in FIG. 17, while FIG. 19 shows a sectional view taken along the dashed line P—P of FIG. 18. When the roller bar 56 is contacted with the log, the projections 58 are rendered to penetrate into the circumferential surface of the log so that the circumferential surface of the log is caught by the edge portions of the projections 58 (namely, the edges 58*b* located at the lower side of each projection when the roller bar 56 is rotated from top to bottom in FIG. 18), thereby making it possible to transmit a sufficient driving force from the roller bar 56 to the lop as in the cases of the above embodiments.

Moreover, due to the smooth circumferential surfaces 58*a* of the projection 58, it is possible to prevent the projections 58 from being excessively penetrated into the circumferential surface of the log. Further, it is possible with the smooth circumferential surfaces 58*a* of the projection 58 to press the circumferential surface of log at a position immediately before the knife 2.

On the other hand, at the side where a portion of the roller bar 56 is contacted with the inner wall 11 of the holding member 8, the smooth circumferential surfaces 58*a* of the projections 58 sustained by the inner wall 11, so that the roller bar 58 can be desirably maintained in place as a whole, thereby making it possible to obtain a veneer excellent in quality under a desired condition.

In the case of this roller bar 56 however, as a result of the rotation of the roller bar 56, the inner wall 11 of the bolding member 8 is erased, though the quantity erased per rotation may be very small, by the lower edges. As a result, a space may be formed between the inner wall 11 and the roller bar 56 with a lapse of time, and hence the position of the roller bar 56 relative to the holding member 8 is caused to change, thus making it impossible to maintain such a predetermined position as explained in FIG. 5. Therefore, due to an insufficient pressing force to the log, various problems such as the generation of large lathe check in the veneer, or non-uniformity in thickness of veneer may be raised.

4. In the case of roller bars 3 and 50, the tip end of each projection and the smooth circumferential surface are made flush with each other in the radial direction of the roller bars. However, the level of the tip end of each projection in the radial direction of the roller bar may be set lower than the level of the smooth circumferential surface 6.

Figure 20:
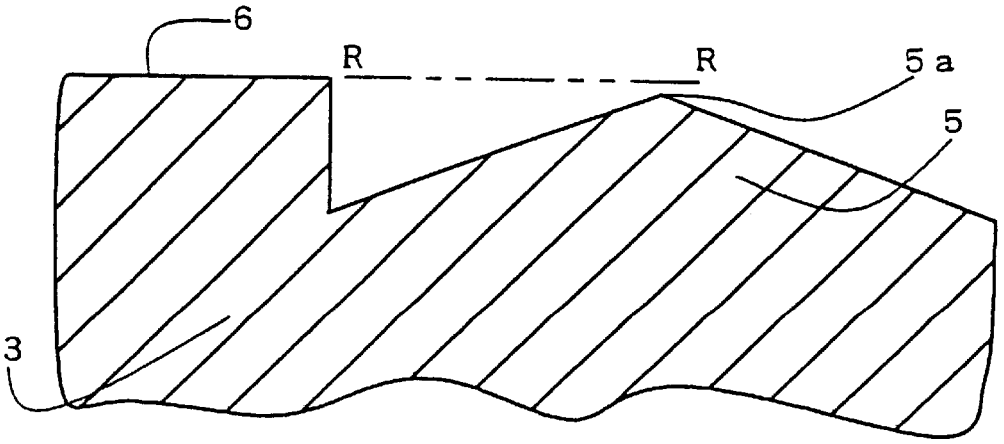
FIG. 20 is an enlarged cross-sectional view illustrating a modified example of a roller bar.

This modified embodiment will be explained below taking the roller bar 3 as an example. As shown in FIG. 20 illustrating a sectional view of one projection and a smooth circumferential surface contiguous to the projection as in the case of FIG. 5, the tip end 5*a* of the projection 5 is set lower by a distance of 0.1 mm (as measured in the radial direction of the roller bar 3 or the perpendicular direction of FIG. 20) than the two dots and one dash line R—R indicating an imaginary line extended horizontally from the smooth surface 6.

It is possible, even with this roller bar, to penetrate the tip end 5*a* of the projection 5 into the circumferential surface of the log in the same manner as explained with reference to FIG. 11 if the position of roller bar relative to the knife 2 is set as explained in FIG. 7, though the degree of penetration may be smaller as compared with the case where the tip end of projection is made flush with the smooth circumferential surface in the radial direction of the roller bar. Therefore, it is possible to transmit a sufficient driving force from the roller bar to the log. The same effects as explained in the aforementioned embodiments can be also expected in this embodiment.

Figure 21:
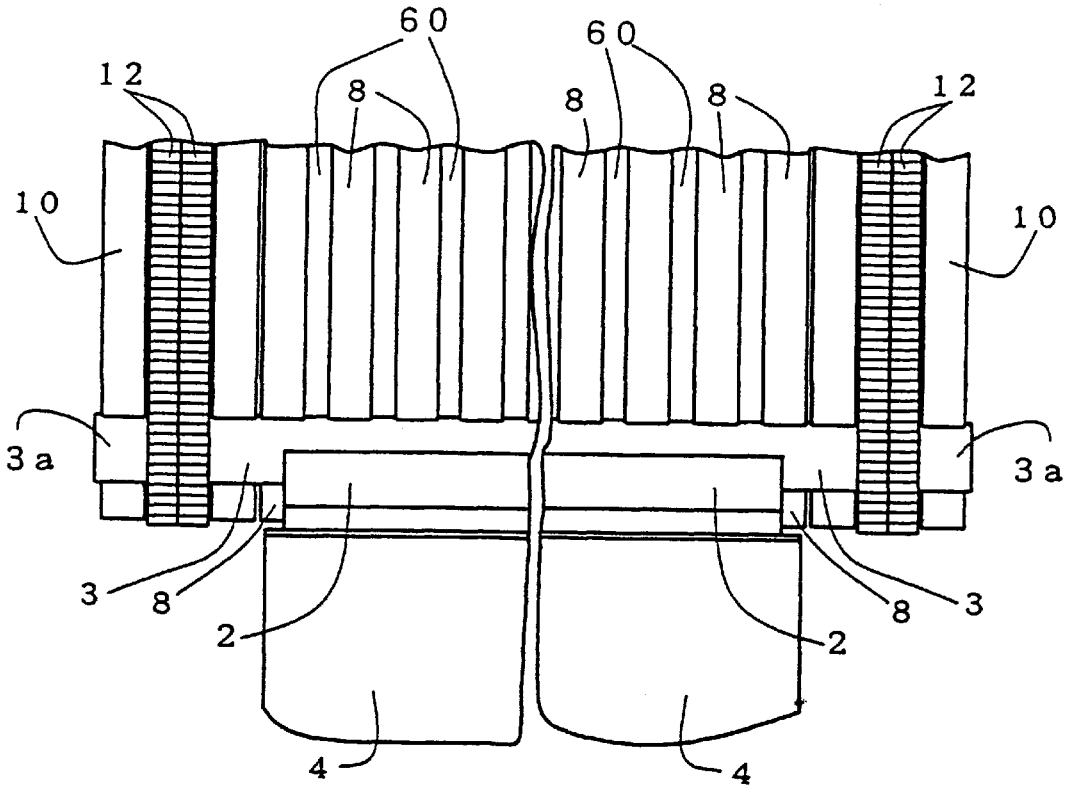
FIG. 21 is a front view illustrating a modified example in arrangement of a sliding bearing.

5. As shown in FIG. 2, the sliding bearings 9 for the roller bar, which are mounted on the holding members 8, are arranged parallel with the cutting edge of the knife 2 and successively without leaving a space therebetween in the aforementioned embodiments. However, it is possible as shown in FIG. 21 to interpose a space between these sliding bearings 9 by interposing a space 60 between the holding members 8.

6. Although the holding member is fixed through one end thereof to the knife stock 4 and is provided through the other end thereof with the sliding bearing in the above embodiments, the holding member may be constructed as explained below.

Figure 22:
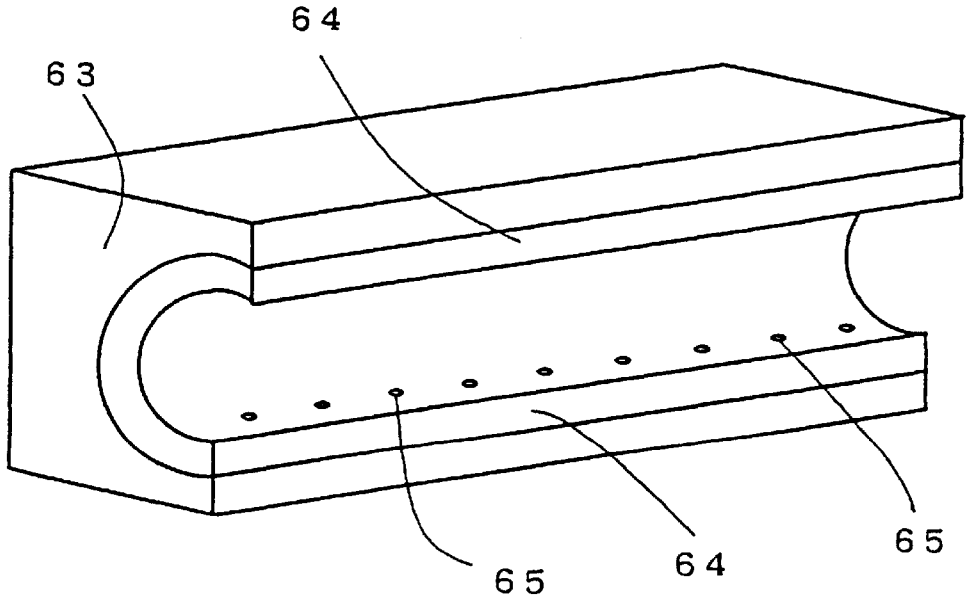
FIG. 22 is a perspective view illustrating a modified example of a sliding bearing.

Namely, as shown in FIG. 22 depicting a perspective view of the holding member, the holding member 63 is shaped into a rectangular parallelepiped having a circularly cut portion on its one side, and a sliding bearing 64 constructed in the same manner as that of the sliding bearing 9 is inserted into this circularly cut portion and fixed therein. Then, any desired kind of roller bar is inserted into this sliding bearing 64.

7. Although the whole length of the roller bar is constituted by a single roll in the embodiments shown in FIGS. 2 and 21, the roller bar may be partitioned for instance at the middle point in the lateral direction of these FIGS., each partitioned roller bar being rotatably supported by a sliding bearing 9.

8. Although the female screw 30*a* and male screw 30*b* engaging with each other are employed for moving the rolls 37 and 38 which are disposed opposite to the knife as a back-up roll designed to move following a decrease in diameter of the log in the peeling operation in the above embodiments, it is also possible to employ the conventional hydraulic or air cylinder for moving the rolls 37 and 38.

As explained above, the roller bar according to this invention is constructed to function not only as a pressure bar but also as a driving force-transmitting medium for transmitting at least part of driving force required for the peeling of log to the log, thus making it possible to overcome the problems accompanied with the conventional apparatus. Furthermore, since these functions can be achieved by a single roller bar, the cost for the apparatus can be saved.

Since the circumferential surface of the roller bar is provided with a smooth surface and a roughened surface, each having a predetermined width, which are successively formed along the direction of the axial line of the roller bar, it is possible to prevent the portion of the inner wall 11 which is contacted with the smooth surface of the roller bar from being erased substantially, thus making it possible to maintain the roller bar in a fixed position and to manufacture a veneer T excellent in quality under a desired condition.

I claim:

1. A veneer lathe which comprises;

a knife for peeling a log, which is secured to a knife stock;

a roller bar disposed to press a circumferential surface of the log at an upstream side, relative to said knife, of a rotational direction of the log;

a plurality of projections, on a circumferential surface of the roller bar, having a height which does not extend beyond a circumferential surface of said roller bar;

a sliding bearing fixed to said knife stock, rotatably sustaining said roller bar and having a semi-circular space in cross-sectional which opens to face the log when said cross-section is cut orthogonally to an axial line of said roller bar, said sliding bearing being mounted to face, via said roller bar, the log to be peeled; and driving means for rotating said roller bar sustained by said sliding bearing.

2. The veneer lathe according to claim 1, wherein said projections are formed all over the circumferential surface of said roller bar.

3. The veneer lathe according to claim 1, wherein said roller bar is constructed such that a plurality of annular smooth surfaces, each being contiguous in the rotational direction of said roller bar and having a width, are formed at intervals on the circumferential surface of the roller bar and along the direction of said axial line of said roller bar, wherein other surface portions of said roller bar excluding said smooth surfaces are provided with said plurality of projections.

4. The veneer lathe according to claim 3, wherein said projections are formed on the circumferential surface of said roller bar in such a manner that the level of tip ends of said projections in the radial direction of said roller bar is flush with the circumferential surface of the roller bar.

5. The veneer lathe according to claim 3, wherein said projections are formed on the circumferential surface of said roller bar in such a manner that the level of tip ends of said projections in the radial direction of said roller bar is lower than the circumferential surface of the roller bar.

6. The veneer lathe according to any one of claims 1 to 5, wherein said bearing consists of a plurality of short sliding bearings arrayed along the direction of the axial line thereof.

7. The veneer lathe according to any one of claims 1 to 5, wherein said sliding bearing consists of a plurality of short sliding bearings arrayed along the direction of the axial line thereof, each sliding bearing being sustained by one end of each of plural holding members whose other ends are respectively cantilevered on the knife stock.

8. The veneer lathe according to any one of claims 1 to 5, wherein the diameter of said roller bar is set to not more than 30 mm.

9. The veneer lathe according to any one of claims 1 to 5, wherein the position of said roller bar relative to said knife is set such that the roller bar is off-set in the direction orthogonal to the rotational direction of the log so as to approach the log by a distance of 15% or more of a thickness of the veneer.

10. The veneer lathe according to any one of claims 1 to 5, which further comprises a back-up roll which moves following a decrease in diameter of the log in a peeling operation and is disposed at a position opposite to said knife.

* * * * *

UNITED STATES PATENT AND TRADEMARK OFFICE

CERTIFICATE OF CORRECTION

PATENT NO.: 5,971,045
DATED : October 26, 1999
INVENTOR(S): Kenzo WATANABE

It is certified that an error appears in the above-identified patent and that said Letters Patent is hereby corrected as shown below:

In the claims;

In Claim 1 on line 26 of column 15, change "cross-sectional" to --cross-section--.

Signed and Sealed this

Eighth Day of May, 2001

*Attest:*

Nicholas P. Godici

NICHOLAS P. GODICI

*Attesting Officer*

*Acting Director of the United States Patent and Trademark Office*